United States Patent [19]
Numano et al.
[11] 4,406,141
[45] Sep. 27, 1983

[54] STRAIGHTENING APPARATUS FOR STEEL PIPES AND THE LIKE

[75] Inventors: Masachika Numano, Yokosuka; Shinji Akita, Yokohama, both of Japan

[73] Assignee: Nippon Kokan Kabushiki Kaisha, Tokyo, Japan

[21] Appl. No.: 291,954

[22] Filed: Aug. 11, 1981

[30] Foreign Application Priority Data

Aug. 21, 1980 [JP] Japan ..... 55-117442[U]

[51] Int. Cl.³ ..... B21D 3/04
[52] U.S. Cl. ..... 72/98; 72/99
[58] Field of Search ..... 72/98, 99, 95, 100, 72/102

[56] References Cited

U.S. PATENT DOCUMENTS 4,057,988 11/1977 Tsukamoto ..... 72/98

FOREIGN PATENT DOCUMENTS 2357570 1/1975 Fed. Rep. of Germany ..... 72/99
55-100824 8/1980 Japan .

*Primary Examiner*—Lowell A. Larson
*Attorney, Agent, or Firm*—Fleit, Jacobson, Cohn & Price

[57] ABSTRACT

An apparatus for straightening the bend in steel pipes, round bars and the like (hereinafter simply referred to as steel pipes). The apparatus includes a first straightener comprising a combination of concave rolls and a second straightener comprising a combination of a concave roll and a convex roll and arranged at least at the entry side or the exit side of the first straightener and the top rolls or the bottom rolls of the first and second straighteners are adapted to be moved vertically, whereby when one or the other of the first and second straighteners presses a steel pipe, the pressure application of the other straightener is released so that the bend extending practically over the entire length of the steel pipe is straightened and the bend in the end portions of the steel pipe is straightened by the second straightener, thus straightening the steel pipe in a short period of time with a high degree of accuracy.

6 Claims, 6 Drawing Figures

STRAIGHTENING APPARATUS FOR STEEL PIPES AND THE LIKE

The present invention relates to a roll-type straightening apparatus for straightening the bend produced in steel pipes, round bars and the like (hereinafter simply referred to as steel pipes) during their manufacture.

In the case of a seamless steel pipe production line, for example, a straightening machine is arranged at the rear of a rolling mill so as to straighten the bend produced in steel pipes during the rolling operation. In a widely-used known type of straightening machine, a plurality of straighteners are arranged in tandem and each of the straighteners includes a set of relatively small concave rolls arranged one upon another with a predetermined spacing therebetween and mounted to make a predetermined angle with the axis. All the rolls or some of the rolls are driven by motors to rotate in a predetermined direction. When a steel pipe whose bend is to be straightened is introduced from one end of the roll clearance formed by the top and bottom rolls, the steel pipe is passed between the rolls while rotating and the bend is straightened in the meantime.

Known straightening machine of this construction has many advantages that it can be used on steel pipes of different outside diameters by changing the gap between the respective rolls making it usable in a wide range of applications, that the operating speed is high and so on and the machine is effective in straightening the bend in steel pipes except their end portions. However, this type of machine is less effective in straightening steel pipes having bent end portions (0.5 to 1.0 m) and it tends to give rise to troubles in the following processing operations such as the thread cutting operation.

To overcome these deficiencies, a straightening machine of the type comprising a combination of concave and convex rolls has been used in some applications. Although this type of machine is undoubtedly much effective in straightening the ends of steel pipes, it has a fatal disadvantage that the speed of straightening is low. In other words, while this straightening machine can increase its straightening speed by increasing the angle made by the top and bottom rolls with the axis, the contact area with a steel pipe will be reduced and the number of times the steel pipe is bent will be decreased thus making it difficult to straighten the bend in the pipe ends. Thus, with a view to overcome this difficulty, the angle made by the top and bottom rolls with the pipe axis has been decreased to increase the contact area with a steel pipe and this method is also disadvantageous in that the straightening speed is decreased considerably and it is impossible to incorporate this method in the modern high-speed (20 to 180 m/min) steel pipe production lines. Moreover, since one of the rolls is convexed so that the steel pipe tends to slip off the roll, a guide shoe is provided on each side of the steel pipe to prevent slip-off and this has the disadvantage of tending to cause on the surface of the steel pipe such defects which are called as shoe marks.

To prevent the occurrence of defects on the surface of steel pipes due to the guide shoes, as disclosed in Japanese Patent Publication No. 55-100824, a type of straightening machine has been proposed in which a pair of rolls comprising a combination of a concave roll and a convex roll is arranged centrally and another pair of rolls comprising a combination of concave rolls is arranged on each side of the central pair thus eliminating the use of guide shoes. However, this type of machine is disadvantageous in that while the pair of rolls comprising a combination of concave and convex rolls is arranged centrally so as to straighten a steel pipe over its entire length (several tens meters) and this has a greater effect in straightening the pipe ends, the straightening operation is slow and inefficient and the machine cannot be incorporated in a high-speed steel pipe production line.

It is therefore the object of the present invention to provide a high-efficiency straightening apparatus for steel pipes and the like which is capable of positively straightening the bend in steel pipes including the pipe end portions and speeding up the straightening operation.

In accordance with the present invention there is thus provided an improved straightening apparatus for steel pipes and the like which comprises a straightener including a combination of concave rolls and another straightener including a combination of concave roll and a convex roll and arranged at least at one or the other of the entry and exit ends of the first straightener whereby when one or the other of the two straighteners presses a steel pipe, the pressure application of the other straightener is released.

The above and other objects, features and advantages of the present invention will become apparent from the following description taken in conjunction with the accompanying drawings, in which.

Figure 1:
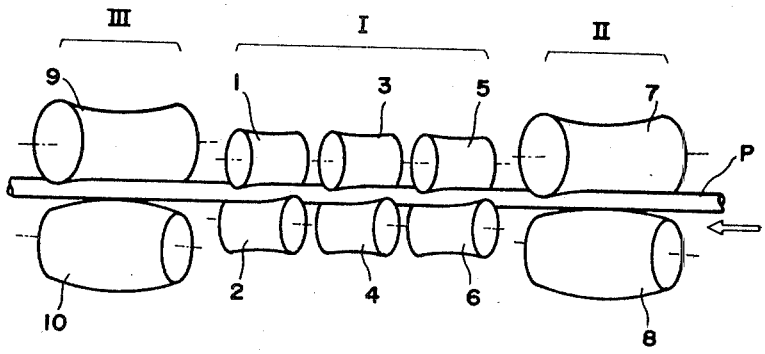
FIG. 1 is a schematic diagram for explaining the principle of a straightening apparatus according to the present invention.

Referring to FIG. 1, numeral 1 designates a first straightener of the previously mentioned known type comprising a combination of concave rolls 1 to 6, II a second straightener comprising a combination of a concave roll 7 and a convex roll 8, and III a third straightener of the same construction as the second straighter II. It should be noted that the first straightener I may be comprised of the top and bottom rolls of different sizes and also the number of rolls is not limited to 6.

The present invention features that in the straightening apparatus constructed as described above, the top rolls 1, 3, 5, 7 and 9 of the straighteners I, II and III are separately movable vertically in the respective straighteners independently of one another by means of hydraulic mechanisms, electro-mechanical mechanisms or the like. In this case, depending on the construction of the straightening apparatus, the bottom rolls 2, 4, 6, 8 and 10 may be moved vertically or alternatively all of the top and bottom rolls 1 to 6, 7, 8, 9 and 10 may be made vertically movable. Although not shown, the straighteners II and III are provided with guide shoes.

Figure 2:
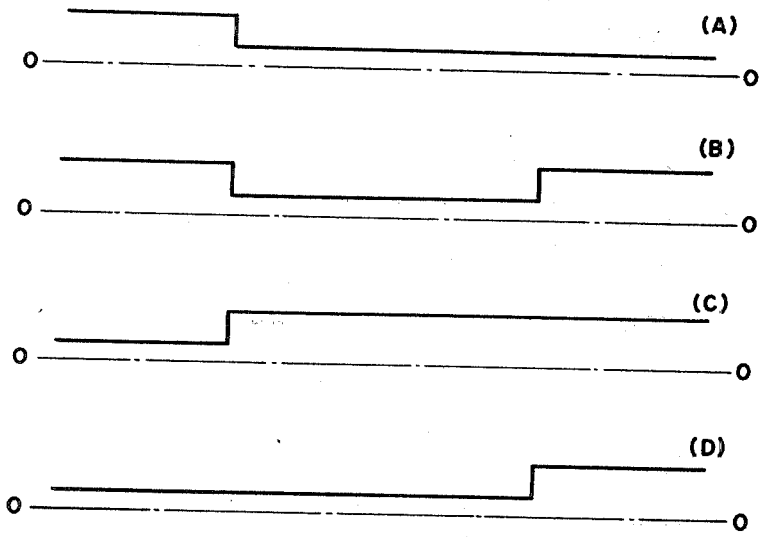
FIG. 2 shows a plurality of diagrams useful for explaining the operation of the apparatus shown in FIG. 1.

With the construction described above, the operation of the apparatus according to the invention will now be described with reference to the diagrams of FIG. 2 showing the positions of the top rolls in the straighteners I to III. When a steel pipe P is fed into the straightener II from the right side of the Figure, the straighteners II and I are rotated while maintaining a predetermined roll clearance about a pass line 0—0 as to provide a suitable amount of pressure force and the top roll 9 of the straightener III is in its raised position as shown in (A) of FIG. 2. The straightening action is applied to the forward end portion of the steel pipe P by the straightener II while feeding the steel pipe P in the direction of the arrow at a relatively low speed. When the forward end portion of the steel pipe P is fed into the straightener I, the top roll 7 of the straightener II is raised as shown in (B) of FIG. 2 and the pressure application is released. At this time, the top roll 9 of the straightener III is maintained in the raised position. The steel pipe P fed into the straightener I is moved in the direction of the arrow at a high speed while being rotated and the straightening action is applied to the steel pipe P practically over its entire length. When the rear end of the steel pipe P leaves the straightener I, as shown in (C) of FIG. 2, the top rolls 1, 3 and 5 of the straightner I are raised and the pressure application is released. Simultaneously, the top roll 9 of the straightener I is lowered and thus the straightening action is applied to the rear end portion of the steel pipe P while moving it forward at a relatively low speed. In this way, the steel pipe P is straightened over its entire length with a high degree of accuracy.

While the order in which the rolls are raised and lowered has been described for explaining the principle of the invention, the present invention is not intended to be limited to this order. For instance, it is possible to arrange so that the top rolls 1, 3 and 5 of the first straightener I are always held in their lowered positions as shown in (D) of FIG. 2 and only the top rolls 7 and 9 of the second and third straighteners II and III are moved vertically. Alternatively, it is possible to arrange so that when the rear end portion of the steel pipe P is straightened by the straightener III as shown in (C) of FIG. 2, the top rolls 1, 3, 5 and 7 of the other straighteners I and II are so positioned that a proper pressure is applied to the steel pipe P.

Figure 3:
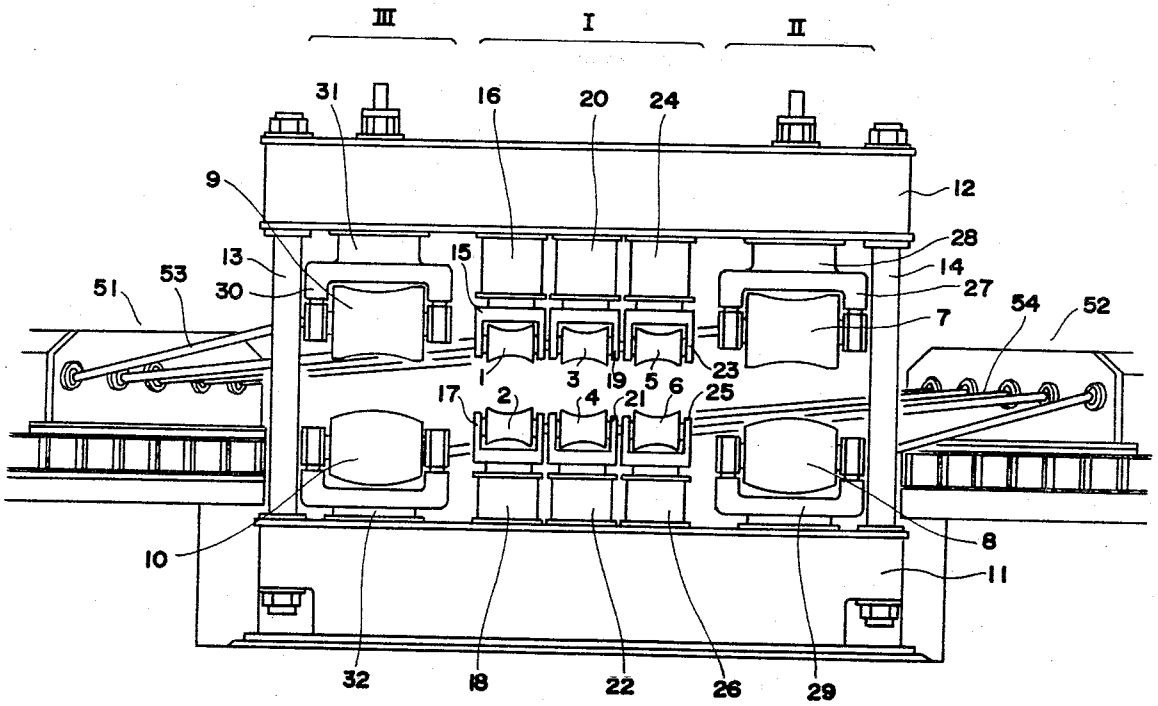
FIG. 3 is a front view of an embodiment of the straightening apparatus according to the invention.
Figure 4:
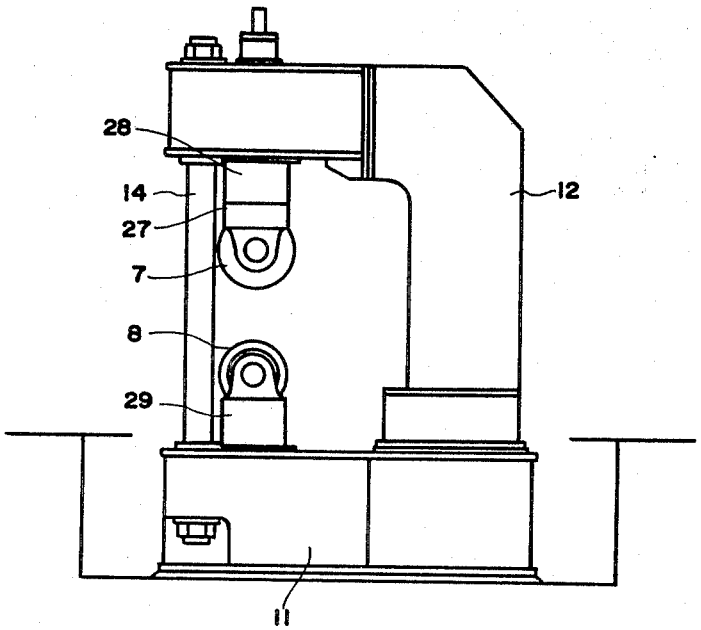
FIG. 4 is a side view of FIG. 3.

FIG. 3 is a front view of an embodiment of the invention and FIG. 4 is its side view. In the Figures, numeral 11 designates a base plate on which an inverted L-shaped frame 12 is vertically mounted, and supports 13 and 14 are arranged between the front part of the frame 12 and the base plate 11. Numerals I, II and III designate first, second and third straighteners. In the first straightener I, small concave rolls 1 and 2 are arranged to oppose each other at a predetermined angle (the rolls are shown planarily in the Figure). The roll 1 is attached to the frame 12 by means of a supporting arm 15 and a lifting mechanism 16 and the roll 2 is fixed to the base plate 11 by means of a supporting arm 17 and a supporting block 18. The other pairs of rolls 3, 4 and 5, 6 are similarly attached to the frame 12 and the base plate 11. In the second straightener II, a large concave roll 7 is attached to the frame 12 by means of a supporting arm 27 and a lifting mechanism 28 and a large convex roll 8 is fixed to the base plate 11 by means of a supporting arm 29. In the like manner, a concave roll 9 and a convex roll 10 of the third straightener III are respectively attached to the frame 12 and the base plate 11. In the present embodiment, the large diameter portion and the length of the rolls 1 to 6 of the first straightener I are respectively 380 mmϕ and 480 mm, and the large diameter portion and the length of the rolls 7 to 10 of the second and third straight II and III are respectively 800 mmϕ and 1,000 mm.

Figure 5:
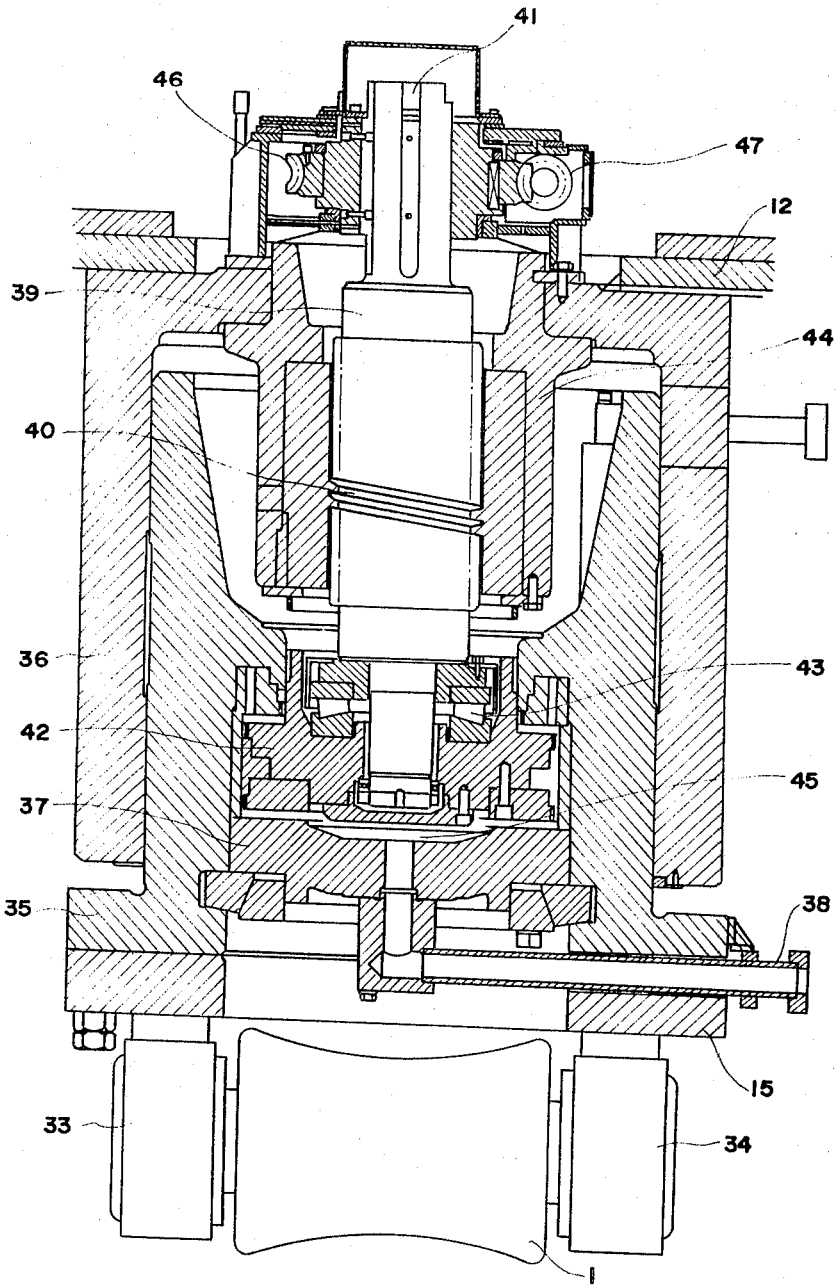
FIG. 5 is a sectional view showing by way of example a roll lifting mechanism.

FIG. 5 shows an exemplary construction of the lifting mechanism 16 of the roll 1 in the first straightener I. The roll 1 is supported on the supporting arm 15 by means of bearings 33 and 34, and the supporting arm 15 is fixedly mounted on a supporting cylinder 35 which is vertically slidably fitted in an outer cylinder 36 fixed to the frame 12. Numeral 37 designates a stationary block which is hermetically fixedly mounted in the supporting cylinder 35, and 38 an oil hydraulic pipe having its one end fixed to the stationary block 37 and its other end connected to a hydraulic unit (not shown). Numeral 39 designates a screwdown shaft including an external thread 40 formed on substantially the central portion and splines 41 formed on the upper part, and a piston 42 disposed within the supporting cylinder 35 is attached to the lower end of the shaft 39 through a bearing 43. Numeral 45 designates an oil hydraulic chamber which is formed between the stationary block 37 and the piston 42 and communicated with the oil hydraulic pipe 38. Numeral 46 designates a worm gear attached to the screwdown shaft 39 by means of the splines 41 and engaged with a worm 47 which is operated by a motor (not shown).

With the construction described above, the operation of the lifting mechanism is as follows. When it is desired for example to maintain the roll 1 in the lowered pressing position as shown in (A) of FIG. 2 so as to straighten a steel pipe P, the hydraulic pressure supplied into the oil hydraulic chamber 45 from the oil hydraulic pipe 38 is increased so that the roll 1 is lowered by means of the stationary block 37, the supporting cylinder 35 and the supporting arm 15. Also, the worm 47 and the worm gear 46 are rotated so that the screwdown shaft 39 and the piston 42 attached to the former are lowered. Thus, the stationary block 37, the supporting cylinder 35, the supporting arm 15 and the roll 1 are lowered by means of the hydraulic pressure in the oil hydraulic chamber 45 so that the clearance between the top and bottom rolls 1 and 2 is adjusted to suit the outer diameter of the steel pipe P and the roll 1 is caused to apply a proper pressure.

Then, to release the pressure application by the rolls 1 and 2 as shown in (C) of FIG. 2, the hydraulic pressure supplied into the oil hydraulic chamber 45 is decreased so that the roll 1 is raised slightly into a free condition and the pressure application is released. If it is desired to again allow the roll 1 to apply a proper pressure, the hydraulic pressure in the oil hydraulic chamber 45 is increased so that the roll 1 is slightly lowered and it is held in position which applies a proper pressure. Although not described, such ordinary means as rotating the supporting cylinder 35 is used to vary the angle of the roll 1.

Referring again to FIG. 3, numerals 51 and 52 designate driving mechanisms for rotating the respective rolls, and shafts 53 and 54 which are driven by motors (not shown) through universal joints are each connected to one of the rolls of the straighteners I, II and III.

In the present embodiment, although not described, lifting mechanisms 20 and 24 of the other rolls 3 and 5 of the first straightener I are identical with the lifting mechanism 16, and also the lifting mechanisms 28 and 31 of the rolls 7 and 9 of the second and third straighteners II and III are similar in construction to the lifting mechanism 16 of the roll 1.

The operation of the embodiment constructed as described above is as follows. In the initial condition, the rolls 7 and 8 of the second straightener II and the rolls 1 to 6 of the first straightener I rotate about the pass line 0—0 while maintaining a predetermined roll clearance and the roll 9 of the third straightener III is in the raised position (see (A) of FIG. 2). In other words, the lifting mechanisms of the rolls 1, 3, 5 and 7 of the first and second straighteners I and II are each operated in such a manner that as shown in FIG. 5 the worm 47 and the worm gear 46 are rotated through the operation of the motor so that the screwdown shaft 39 and the supporting cylinder 35 are lowered and each of the rolls 1,3, 5 and 7 is allowed to provide a suitable amount of pressure, and the motor of the lifting mechanism 31 is rotated in the reverse direction so that the roll 9 of the third straightener III is raised.

Disposed at the entry side of the second straightener II is a sensor (not shown) for sensing the passage of the forward end of the steel pipe P by means of light, for example, so that when the forward end of the steel pipe P passes the sensor, this is sensed and a timer is operated. When the forward end of the steel pipe 1 is introduced into the second straightener II so that the bend in the pipe end portion is straightened and then fed into the first straightener I, in accordance with the predetermined conditions the hydraulic pressure in the oil hydraulic chamber of the lifting mechanism 28 in the second straightener II is instantly decreased and the roll 7 is raised. As a result, the steel pipe P is straightened by the first straightener I practically over its entire length at a high speed (see (B) of FIG. 2). When the rear end of the steel pipe P leaves the first straightener I, in accordance with preset conditions the rolls 1, 3 and 5 are raised to release their pressure application and also the roll 9 of the third straightener III is lowered to straighten the rear end portion of the steel pipe P with a proper pressure force (see (C) of FIG. 2). The feeding speed of the steel pipe P is set to a predetermined speed for each of the straighteners I, II and III so that if the necessary conditions are predetermined in accordance with the time of operation of the timer as a reference point, the steel pipe P can be straightened automatically in such a manner that the foward and rear end portions or the limited areas are straightened at a relatively low speed and the straightening of practically the entire length (several tens meters) are straightened at a high speed, thus accomplishing the straightening of the steel pipe as a whole accurately at a high speed which is matched to the speed of the modern steel pipe production lines.

It is to be noted that various means may be used for vertically moving the rolls in the straighteners I, II and III. For example, it is possible to arrange so that the timer is operated as soon as the steel pipe P is introduced into the second straightener II, whereby in response to an electronic computer having the various conditions such as the feeding speeds of the straighteners I, II and III preset thereinto, the roll 7 of the second straightener II is raised at the expiration of a predetermined time after the beginning of the introduction and then the roll 9 of the third straightener III is lowered at the expiration of another predetermined time.

Figure 6:
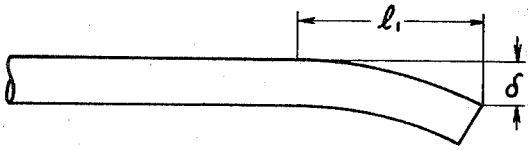
FIG. 6 is a diagram showing the condition of a steel pipe prior to its straightening.

In the case of a prior art straightening apparatus comprising sets of concave rolls, if the bend $\delta$ in the pipe end portion $l_1$ (0.5 to 1 m) of the steel pipe P was 2 to 10 mm as shown in FIG. 6, it was impossible to straighten the bend. The result of the straightening effected by the straightening apparatus according to the above-described embodiment of the present invention showed that the bend $\delta$ was reduced to less than 0.5 mm.

While, in the embodiment described above, the rolls are moved vertically, in the case of a straightening apparatus in which the rolls are arranged on both sides the rolls must of course be moved laterally. Further, while, in each of the straighteners II and III, the concave roll is arranged at the top and the convex roll is arranged at the bottom, the positions of the rolls may be reversed. Still further, while no description is made of the guide shoes included in the straighteners II and III, the guide shoes may be advantageously moved laterally along with the vertical movement of the top rolls. Still further, while, in the above-described embodiment, the straighteners II and III each comprising a set of concave and convex rolls are respectively arranged in the entry and exit sides of the straightener I, one of the straighteners II and III may be eliminated. Still further, while one form of the drive mechanisms for vertically moving the rolls is shown in FIG. 5, the present invention is not intended to be limited to it and any other mechanism may of course be used provided that the similar function is served.

It will thus be seen from the foregoing description that in accordance with the bend straightening apparatus for steel pipes according to this invention, the straightening of a steel pipe is accomplished for the most part by the straightener of the ordinary type comprising the concave rolls at a high speed and the pipe end portions are straightened by the straighteners arranged at the front and back of the ordinary straightener and each comprising the concave and convex rolls, thus straightening the steel pipe in a short period of time with a high degree of accuracy.

What is claimed is:

1. A straightening apparatus for steel pipes or the like comprising:
   - a first straightener including a plurality of pairs of upper and lower concave rolls;
   - a second straightener including a pair of a concave roll and a convex roll arranged one upon the other and at one of the entry and exit sides of said first straightener;
   - a means attached to one roll of each roll pair of said first and second straighteners for moving these rolls vertically, independently of one another, whereby when one of said first and second straighteners is pressing on a steel pipe, pressure by the other is released, thus straightening the steel pipe in its entire length.

2. An apparatus according to claim 1, wherein each of the upper rolls in said first, second and third straighteners is vertically movable by an electric motor or hydraulic means.

3. A straightening apparatus according to claim 1, wherein said means for moving rolls vertically comprises a supporting cylinder rotatably supporting upper rolls or lower rolls and vertically slidably fitted in a fixed outer cylinder, an oil hydraulic chamber disposed in said supporting cylinder, and a screw-down shaft having its lower end attached to a piston disposed within said oil hydraulic chamber, its intermediate portion screwed on said fixed outer cylinder and its rear end portion connected to rotation means in a vertically movable manner.

4. A straightening apparatus for steel pipes or the like comprising:

a first straightener including a plurality of pairs of upper and lower concave rolls;

a second straightener consisting of a pair of a concave roll and a convex roll arranged one upon the other and disposed at the entry side of said first straightener;

a third straightener consisting of a pair of a concave roll and a convex roll arranged one upon the other and disposed at the exit side of said first straightener; and a means attached to one roll of each roll pair of said first, second and third straighteners for moving these rolls vertically, independently of one another, whereby when one of the first, second and third straighteners is pressing on a steel pipe, pressure by the other two straighteners is released, thus straightening the steel pipe in its entire length.

5. A straightening apparatus for steel pipes or the like comprising:

a first straightener including a plurality of pairs of upper and lower concave rolls;

a second straightener including a pair of a concave roll and a convex roll arranged one upon the other and at one of the entry and exit sides of said first straightener; and a means for selectively disengaging said first and second straighteners by selectively opening the roll pairs of said first and second straighteners, whereby when one of said first and second straighteners is pressing on a steel pipe, pressure by the other is released, thus straightening the steel pipe in its entire length.

6. A straightening apparatus for steel pipes or the like comprising:

a first straightener including a plurality of pairs of upper and lower concave rolls;

a second straightener consisting of a pair of a concave roll and a convex roll arranged one upon the other and disposed at the entry side of said first straightener;

a third straightener consisting of a pair of a concave roll and a convex roll arranged one upon the other and disposed at the exit side of said first straightener; and a means for selectively disengaging said first, second and third straighteners by selectively opening the roll pairs of said first, second and third straighteners, whereby when one of said first, second and third straighteners is pressing on a steel pipe, pressure by the others is released, thus straightening the steel pipe in its entire length.

* * * * *